US009275606B2

(12) United States Patent
Lee et al.

(10) Patent No.: US 9,275,606 B2
(45) Date of Patent: Mar. 1, 2016

(54) DISPLAY DEVICE, CONTROL DEVICE FOR DRIVING THE DISPLAY DEVICE, AND DRIVE CONTROL METHOD THEREOF

(71) Applicant: Samsung Display Co., Ltd., Yongin, Gyeonggi-do (KR)

(72) Inventors: Dong-Woo Lee, Yongin (KR); Wook Lee, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 163 days.

(21) Appl. No.: 13/935,270

(22) Filed: Jul. 3, 2013

(65) Prior Publication Data

US 2014/0009512 A1 Jan. 9, 2014

(30) Foreign Application Priority Data

Jul. 4, 2012 (KR) ..... 10-2012-0073001

(51) Int. Cl.
*G09G 3/32* (2006.01)
*G09G 5/02* (2006.01)

(52) U.S. Cl.
CPC ..... *G09G 5/02* (2013.01); *G09G 3/3233* (2013.01); *G09G 2320/0673* (2013.01); *G09G 2320/0693* (2013.01); *G09G 2330/00* (2013.01); *G09G 2330/028* (2013.01)

(58) Field of Classification Search
CPC ..... G09G 2320/0233
See application file for complete search history.

(56) References Cited

U.S. PATENT DOCUMENTS

2005/0156831 A1* 7/2005 Yamazaki et al. ..... 345/76
2008/0111812 A1* 5/2008 Shirasaki et al. ..... 345/212
2009/0278773 A1* 11/2009 Chegal ..... 345/77

FOREIGN PATENT DOCUMENTS

JP 06-204873 A 7/1994
JP 2002-076897 A 3/2002
JP 2005-227412 A 8/2005
KR 10-2005-0005198 A 1/2005

* cited by examiner

*Primary Examiner* — Quan-Zhen Wang
*Assistant Examiner* — Chad Dicke
(74) *Attorney, Agent, or Firm* — Knobbe, Martens, Olson & Bear, LLP

(57) ABSTRACT

A display device, a driving control device of the display device, and a driving control method are disclosed. In one aspect, the display device comprises a display unit consisting of a plurality of pixels including a light emitting element emitting light according to a driving current corresponding to a data signal; a scan driver transmitting a scan signal through a plurality of scan lines; a data driver transmitting a data signal through a plurality of data lines; a power supply unit supplying a driving voltage to drive a plurality of pixels through a power source wire; and a driving controller connected to the power source wire, obtaining an actual output voltage value of the driving voltage output from the power source voltage supply unit, and compensating a deviation of the driving voltage in a process step by using the actual output voltage value.

19 Claims, 7 Drawing Sheets

DISPLAY DEVICE, CONTROL DEVICE FOR DRIVING THE DISPLAY DEVICE, AND DRIVE CONTROL METHOD THEREOF

CROSS-REFERENCE TO RELATED APPLICATION

This application claims priority to and the benefit of Korean Patent Application No. 10-2012-0073001 filed in the Korean Intellectual Property Office on Jul. 4, 2012, the entire contents of which are incorporated herein by reference.

BACKGROUND

1. Field

The described technology relates to a display device, a driving control device of the display device, and a driving control method. The described technology also relates to a driving control device of a display device realizing a compensated image according to a voltage characteristic change of an organic light emitting element and a driving control method, and a display device using the same.

2. Description of the Related Technology

In general, in a manufacturing process of a display device using a predetermined gamma voltage for improving image quality and luminance compensation for an image data signal is beneficial.

The gamma voltage predetermining process is a process of a module unit for determining a gamma voltage for each grayscale for the luminance according to each grayscale to be a 2.2 gamma curve. In general, the 2.2 gamma curve has luminescence characteristics that are optimally recognized by eyes of a person.

The compensation process for the input data is performed with reference to the gamma voltage determined through a process for predetermining the gamma voltage.

For predetermining the gamma voltage, a test device is connected to the display panel, and a driving power source voltage ELVDD as a reference is supplied to the display panel through a DC-DC converter of the test device. Accordingly, the gamma voltage for the entire grayscale is determined for the luminance according to each grayscale to be the 2.2 gamma curve.

Also, after the module process of the display device for predetermining the gamma voltage, in a completed product, the driving voltage is supplied to the display panel through the DC-DC converter provided in the display device.

Through this manufacturing process of, the DC-DC converter is changed and a difference is generated in the supply environment of the driving voltage, and thereby a deviation may be generated between an output of the driving power source voltage used in the gamma voltage predetermining process and the actual output of the driving power source voltage of the display device as the completed product. Also, connection resistance in the gamma voltage predetermining process is different from the connection resistance used in the actual display device such that the output of the driving power source voltage may have be different during manufacturing of the display device than during use of the actual completed product.

By the deviation of the driving power source voltage, a light emitting characteristic between each pixel may have a difference such that luminance and color coordinates corresponding to each pixel may be changed.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

An exemplary embodiment provides a driving control device to compensate a light emitting characteristic (luminance, color coordinates, etc.) difference of each pixel according to a difference between a driving power source voltage level supplied in a test step of a manufacturing process of a display device and a driving power source voltage level supplied in a display device as a completed product, a driving control method, and a display device using the same.

Also, an exemplary embodiment improves a yield of a display device and display quality by controlling driving of a display device for a change of the driving power source voltage due to a change of a load of the display panel according to an environment and a state to be minimized.

Particularly, the change amount of the driving power source voltage may be increased by increasing the current as a size of the display panel such as a smart phone, a tablet PC, and a large TV is increased, and the present invention solves image quality non-uniformity and luminance compensation.

One disclosed aspect relates to a display device comprising a display unit comprising a plurality of pixels, each pixel having a light emitting element, configured to emit light according to a driving current which corresponds to a data signal; a plurality of scan lines connected to the plurality of pixels; a scan driver configured to transmit a scan signal through each of the plurality of scan lines; a plurality of data lines connected to the plurality of pixels; a data driver configured to transmit a data signal through each of the plurality of data lines; a power source voltage supply unit configured to supply a driving voltage to drive the plurality of pixels through a power source wire connected to the plurality of pixels; a driving controller connected to the power source wire, configured to obtain an actual output voltage value of the driving voltage, and configured to compensate for a deviation of a manufacturing driving voltage used in a manufacturing process by using the actual output voltage value of the driving voltage.

In some embodiments, the driving controller is configured to generate and transmit to the data driver a reference gamma voltage to form a gray voltage corresponding to the data signal by using the actual output voltage value of the driving voltage.

In some embodiments, the reference gamma voltage is a voltage value calculated by subtracting a threshold voltage of a driving transistor included in the plurality of pixels from the actual output voltage value of the driving voltage.

In some embodiments, the driving controller comprises a register including a plurality of resistors and a current sink unit configured to sink a predetermined current, and wherein the driving controller is configured to output the actual output voltage value of the driving voltage as the reference gamma voltage.

In some embodiments, the driving controller comprises: a voltage generator to which a plurality of resistors are connected; a decoder configured to receive a voltage divided in the voltage generator and output a predetermined first voltage; and a reference voltage output unit configured to output a difference voltage between the actual output voltage value of the driving voltage and the first voltage as the reference gamma voltage.

In some embodiments, the the predetermined first voltage is a threshold voltage of a driving transistor included in a plurality of pixels.

In some embodiments, the driving controller is configured to: calculate the actual output voltage value of the driving voltage and the digital value of the image data signal corresponding to an external video signal, generate a compensation data signal in which the deviation with the manufacturing driving voltage is compensated, and transmit the compensation data signal to the data driver.

In some embodiments, the driving controller comprises a signal converter and a calculator, and wherein the signal converter converts an analog signal of the actual output voltage value into a digital signal.

In some embodiments, the compensation data signal is equal to the the actual output voltage value of the driving voltage subtracted from the digital value of the image data signal input to the driving controller.

Some embodiments disclosed herein describe a driving control device driving a plurality of pixels each pixel comprising a light emitting element and a driving transistor connected to one end of the light emitting element, the driving transistor configured to transmit a driving current according to a data signal transmitted from a data line to the light emitting element, wherein the driving control device includes means to obtain an actual output voltage value from a power source which supplies a driving voltage to drive the plurality of pixels and a compensation means configured to compensate for a deviation with the driving voltage by using the actual output voltage value.

In some embodiments, the compensation means of the driving control device is a means for generating and transmitting the reference gamma voltage for forming a gray voltage according to the data signal respectively transmitted to the plurality of pixels by using the actual output voltage value.

In some embodiments, the reference gamma voltage is a voltage value where a threshold voltage of a driving transistor included in a plurality of pixels is subtracted from the actual output voltage value of the driving voltage.

In some embodiments, the compensation means of the driving control device comprises a register including a plurality of resistors and a current sink unit configured to sink a predetermined current, and configured to output the actual output voltage value of the driving voltage as the reference gamma voltage.

In some embodiments, the compensation means of the driving control device comprises a voltage generator comprising a plurality of interconnected resistors; a decoder receiving a voltage divided in the voltage generator configured to] output a predetermined first voltage, and a reference voltage output unit configured to output a voltage difference between the actual output voltage value and the first voltage as the reference gamma voltage.

In some embodiments, the first voltage is a threshold voltage of a driving transistor included in the plurality of pixels.

In some embodiments, the voltage generator includes a plurality of resistors coupled in series between the reference voltage and a ground voltage, and wherein the voltage generator is configured to predetermine the reference voltage, a number of a plurality of resistors, and a resistance to generate a plurality of division voltages in a predetermined voltage range with reference to the first voltage.

In some embodiments, the reference voltage output unit includes a differential amplifier configured to output a difference voltage between the actual output voltage value and the first voltage as the reference gamma voltage.

In some embodiments, the compensation means of the driving control device is a means for: calculating the actual output voltage value and the digital value of the image data signal corresponding to an external video signal; generating a compensation data signal in which the deviation with the manufacturing driving voltage is compensated; and transmitting the compensation data signal to a plurality of pixels.

In some embodiments, the compensation means of the driving control device includes a signal converter configured to convert an analog signal of the actual output voltage value of the driving voltage into a digital signal, and a calculator configured to calculate the actual output voltage value of the digital signal and the digital value of the image data signal.

In some embodiments, the calculator subtracts a deviation from the actual output voltage value that is converted into the digital signal from the digital value of the image data signal.

Some embodiments disclosed herein relate to a method for driving a plurality of pixels having a light emitting element and a driving transistor connected to one end of the light emitting element comprising: transmitting a driving current according to a data signal transmitted from a data line to the light emitting element; obtaining an actual output voltage value output from a power supply device which supplies a driving voltage to drive the plurality of pixels; and compensating a deviation with the driving voltage by using the actual output voltage value, wherein the compensating includes generating and transmitting a reference gamma voltage to form a gray voltage according to the data signal respectively transmitted to a plurality of pixels by using the actual output voltage value of the driving voltage.

In some embodiments, the reference gamma voltage is a threshold voltage of the driving transistor included in the plurality of pixels subtracted from the actual output voltage value of the driving voltage.

Some embodiments disclosed herein relate to a method driving a plurality of pixels including a light emitting element and a driving transistor connected to one end of the light emitting element and transmitting a driving current according to a data signal transmitted from a data line to the light emitting element, comprising obtaining an actual output voltage value output from a power source voltage supply device supplying a driving voltage to drive a plurality of pixels; and compensating a deviation with a manufacturing driving voltage during a manufacturing step by using the actual output voltage value, wherein the compensating includes: converting an analog signal of the actual output voltage value into a digital signal, calculating the actual output voltage value converted into the digital signal and the digital value of the image data signal corresponding to an external video signal, and generating a compensation data signal compensating a deviation from the driving voltage by a result value of a calculation; and transmitting the compensation data signal to the plurality of pixels.

In some embodiments, the compensation data signal is a value where the deviation with the driving voltage in a process step included in the actual output voltage value that is converted into the digital signal is subtracted from the digital value of the image data signal.

According to the present invention, the change of the light emitting characteristic (luminance, color coordinates, etc.) of the display element due to the output deviation of the driving power source voltage that is changed in the display device in the manufacturing process and after the finished product may be prevented.

Also, according to the present invention, although the output deviation of the driving power source voltage is generated when mounting a DC-DC converter or in different environments or states, the same light emitting characteristic is maintained in the entire display panel such that high image quality may be realized.

Accordingly, a high degree of freedom for design may be realized when manufacturing the display device, luminance accuracy in the entire grayscale region may be realized for the output change of the driving power source voltage by the load change of the organic light emitting element according to an on pixel ratio, and furthermore a yield improvement of the display device and an increase of the quality of the OLED may be realized.

As the size of the display device is increased, the change amount of the driving power source voltage due to the increase of the current is compensated such that the driving control device and the method thereof improving the display quality may be provided.

DETAILED DESCRIPTION OF CERTAIN ILLUSTRATIVE EMBODIMENTS

Figure 1:
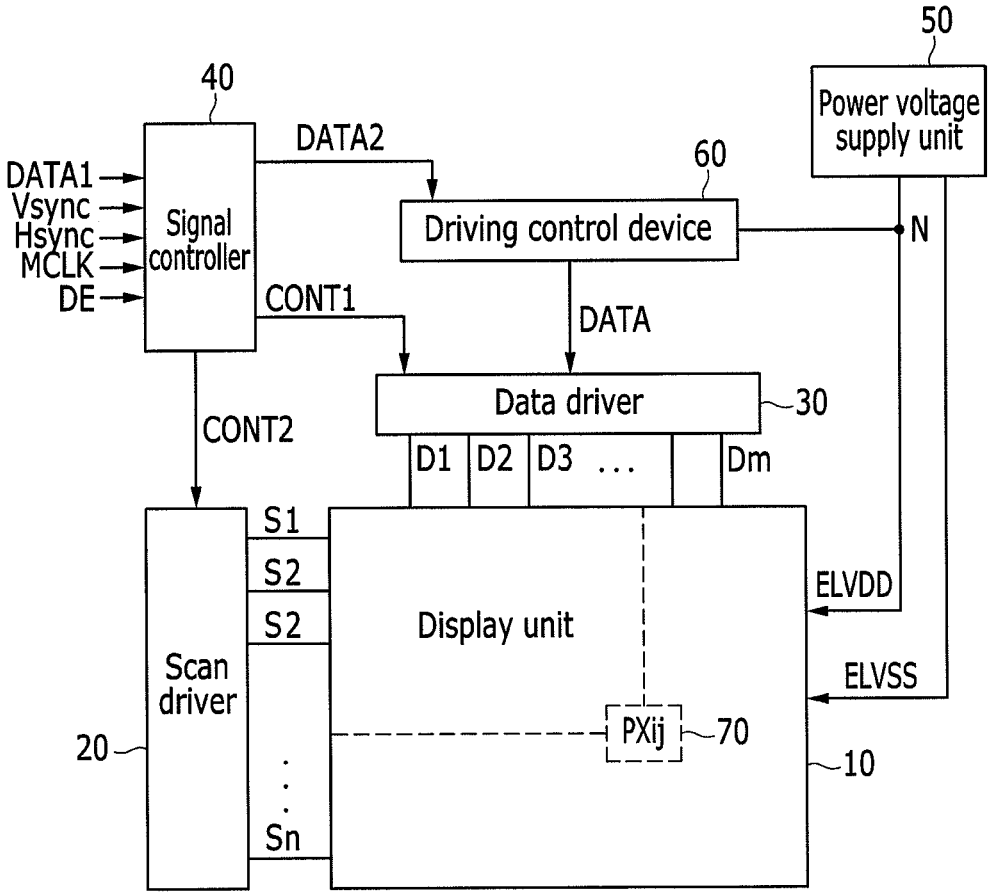
FIG. 1 is a schematic block diagram of a display device according.

Hereinafter, some exemplary embodiments will be described with reference to the accompanying drawings in order for those skilled in the art to be able to readily implement them. As those skilled in the art would realize, the described embodiments may be modified in various different ways, all without departing from the spirit or scope of the present invention.

In addition, parts not related to the description are omitted for clear description of the present invention, and like reference numerals designate like elements and similar constituent elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a schematic block diagram of an embodiment of a display device.

Referring to FIG. 1, a display device includes a display unit 10 including a plurality of pixels 70, a scan driver 20, a data driver 30, a signal controller 40, a power source voltage supply unit 50, and a driving control device 60.

The display unit 10 is a display panel including a plurality of pixels 70 connected to corresponding scan lines among a plurality of scan lines S1-Sn and corresponding data lines among a plurality of data lines D1-Dm. A plurality of pixels respectively display the image corresponding to an image data signal transmitted to the corresponding pixel.

The plurality of pixels included in the display unit 10 are respectively connected to the plurality of scan lines S1-Sn and the plurality of data lines D1-Dm and are arranged in a matrix. The plurality of scan lines S1-Sn are approximately arranged in rows are substantially parallel to each other. The plurality of data lines D1-Dm are arranged approximately in columns and substantially parallel to each other. The plurality of pixels PX of the display unit 60 are respectively supplied with a driving power source voltage from the power source voltage supply unit 50, which supplies the first driving voltage ELVDD and the second driving voltage ELVSS.

The scan driver 20 is connected to the plurality of scan lines S1-Sn. The scan driver 20 generates a plurality of scan signals activating each pixel of the display unit 10 according to a scan control signal CONT2 and transmits them to the corresponding scan line among the plurality of scan lines S1-Sn.

The scan control signal CONT2 is an operation control signal of the scan driver 20 that is generated from the signal controller 40 and is transmitted. The scan control signal CONT2 may include a scan start signal SSP and a clock signal CLK. The scan start signal SSP is a signal generating a first scan signal to display the image of one frame. The clock signal CLK is a synchronization signal to sequentially apply the scan signal to the plurality of scan lines S1-Sn.

The data driver 30 is connected to each pixel of the display unit 10 through the plurality of data lines D1-Dm. The data driver 30 receives and transmits an image data signal DATA to the corresponding data line among the plurality of data lines D1-Dm according to a data control signal CONT1.

The data control signal CONT1 is an operation control signal of the data driver 30 that is generated from the signal controller 40 and is transmitted to data driver 30.

The data driver 30 selects a gray voltage according to the image data signal DATA and according to the gamma voltage that is compensated in the driving control device 60. The data driver 30 transmits the gray voltage to the plurality of data lines D1-Dm as a data signal.

The signal controller 40 receives an external video signal DATA1 input and an input control signal controlling display of the video signal DATA1. The video signal DATA1 includes luminance information for each pixel PXij, and the luminance information has a grayscale value having a predetermined number, for example, $1024=2^{10}$, $256=2^{8}$, or $64=2^{6}$.

As examples of the input control signal transmitted to the signal controller 40, there are a vertical synchronization signal Vsync, a horizontal synchronization signal Hsync, a main clock signal MCLK, and a data enable signal DE.

The signal controller 40 properly processes the input video signals DATA1 based on the input video signals DATA1 and the input control signal according to an operation condition of the display unit 10 and the data driver 30. Specifically, the image data signal DATA2 may be generated and may be output through an image processing process such as luminance compensation on the video signal DATA1.

The signal controller 40 transmits the scan control signal CONT2 which controls the operation of the scan driver 20, to the scan driver 20. The signal controller 40 generates the data control signal CONT1, which controls the operation of the data driver 30, and transmits CONT1 to the data driver 30. Signal controller 40 transmits the image data signal DATA2 to driving control device 60 which is then processed.

The power source voltage supply unit 50 supplies the driving power source voltage stored to an external or internal storage device for driving each pixel of the display unit 10.

The power source voltage supply unit 50 is electrically connected to each pixel through a power source wire supplying the driving power source voltage to each pixel of the display unit 10. The driving power source voltage may be the first power source voltage ELVDD of a high level and the second power source voltage ELVSS of a low lever for the first power source voltage, or a ground potential.

The driving control device 60 is electrically connected to a power source wire at node N, transmitting the first power source voltage ELVDD from the power source voltage supply unit 50 to the display unit 10.

The driving control device 60 may receive an actual voltage value of the first power source voltage ELVDD transmitted from the power source voltage supply unit 50 through the connection node in real time.

During the manufacturing process of the display device, the driving voltage is supplied through a DC-DC converter in a module unit process to predetermine a reference gamma voltage value for luminance compensation of the display panel. The reference gamma voltage is the highest voltage among a plurality of gamma voltages corresponding to the data signal. When the driving transistor of the pixel is a P-channel field effect transistor (PMOS), the reference gamma voltage is the voltage for the organic light emitting element to emit with the lowest grayscale.

The DC-DC converter is generally mounted to the display panel module, and the DC-DC converter is mounted to the power source voltage supply unit 50 in the display device after completion of manufacturing of the display device to transmit the power source voltage driving the pixel.

Thus, a difference is generated between the power source voltage ELVDD level supplied in the luminance compensation process step and the power source voltage ELVDD level supplied from the power source voltage supply unit 50 mounted to the display device. This difference of the driving power source voltage changes the reference gamma voltage value such that a light characteristic such as the luminance or the color coordinate is changed when each pixel of the display device actually displays the image.

Figure 3:
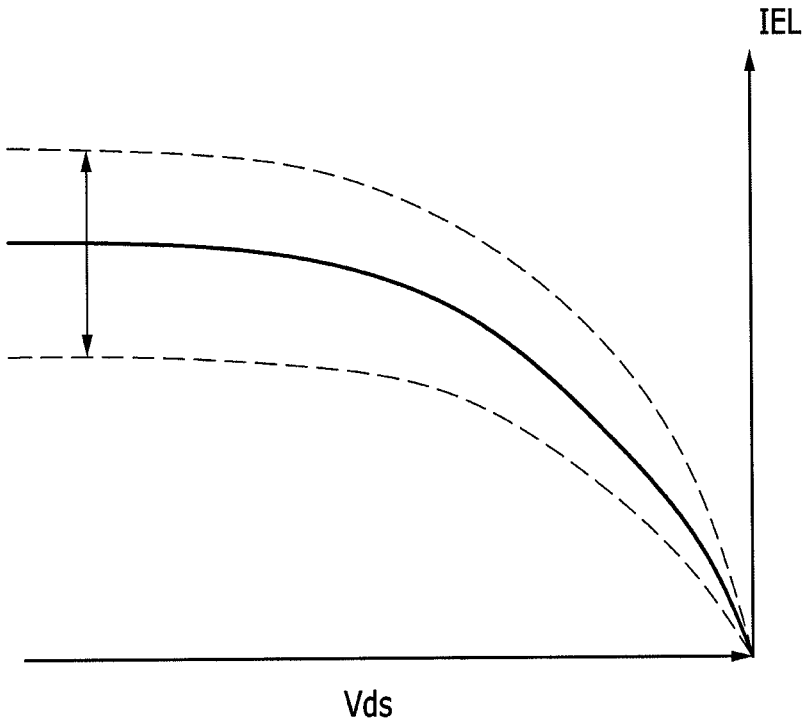
FIG. 3 is a graph of a relationship of a voltage (Vds) between a drain and a source and a driving current (IEL) of a driving transistor of a pixel according to an output deviation of a driving power source voltage respectively supplied in a manufacturing step and a step after completion of a conventional display device.

This changing of the light characteristic of the pixel according to a variation of the driving power source voltage is schematically shown in a graph of FIG. 3. FIG. 3 is a graph of a relationship of a drain-source voltage of the driving transistor of the pixel and a driving current.

Referring to FIG. 3, the driving power source voltage applied to the source electrode of the driving transistor of the pixel is not uniform because of the output deviation of the driving power source voltage used in the luminance compensation step of the manufacturing process of the display device and the driving power source voltage used in the image realization step in the actual completed product. Accordingly, the operation range of the driving transistor of the pixel is changed as shown by the dotted line.

The driving current (IEL) flowing to the organic light emitting element (OLED) is generated corresponding to the voltage difference (Vgs) between the gate-source of the driving transistor of the pixel, and the voltage (Vgs) between the gate-source of the driving transistor is changed by the deviation of the driving power source voltage ELVDD that is connected and transmitted to the source electrode of the driving transistor, thereby changing the driving current amount. Accordingly, the emitted light may not be of the correct luminance or color coordinate for the data signal.

The driving control device 60 of FIG. 1 compensates the output of the driving power source voltage to eliminate the output deviation of the driving power source voltage influencing the change of the light characteristic of the pixel. Accordingly, the output deviation between the manufacturing driving power source voltage in the module unit of the manufacturing process and the driving power source voltage is transmitted in the display device as the completed product and is compensated to account for the light characteristic deviation of the pixel.

The driving control device 60 obtains the voltage value of the driving power source voltage ELVDD which is output from the completed display device in order to eliminate the output voltage deviation from the driving power source voltage, when it predetermines the reference gamma voltage in the luminance compensation.

In some embodiments, the driving control device 60 receives the image data signal DATA2 and obtains the voltage value of the driving power source voltage ELVDD actually output in the display device and uses it to adjust a digital value of the corresponding image data signal by the output voltage deviation with the driving power source voltage when it predetermines the reference gamma voltage.

The detailed constitutions of the driving control device 60 according to an exemplary embodiment of the present invention will be described later with reference to accompanying drawings.

Figure 2:
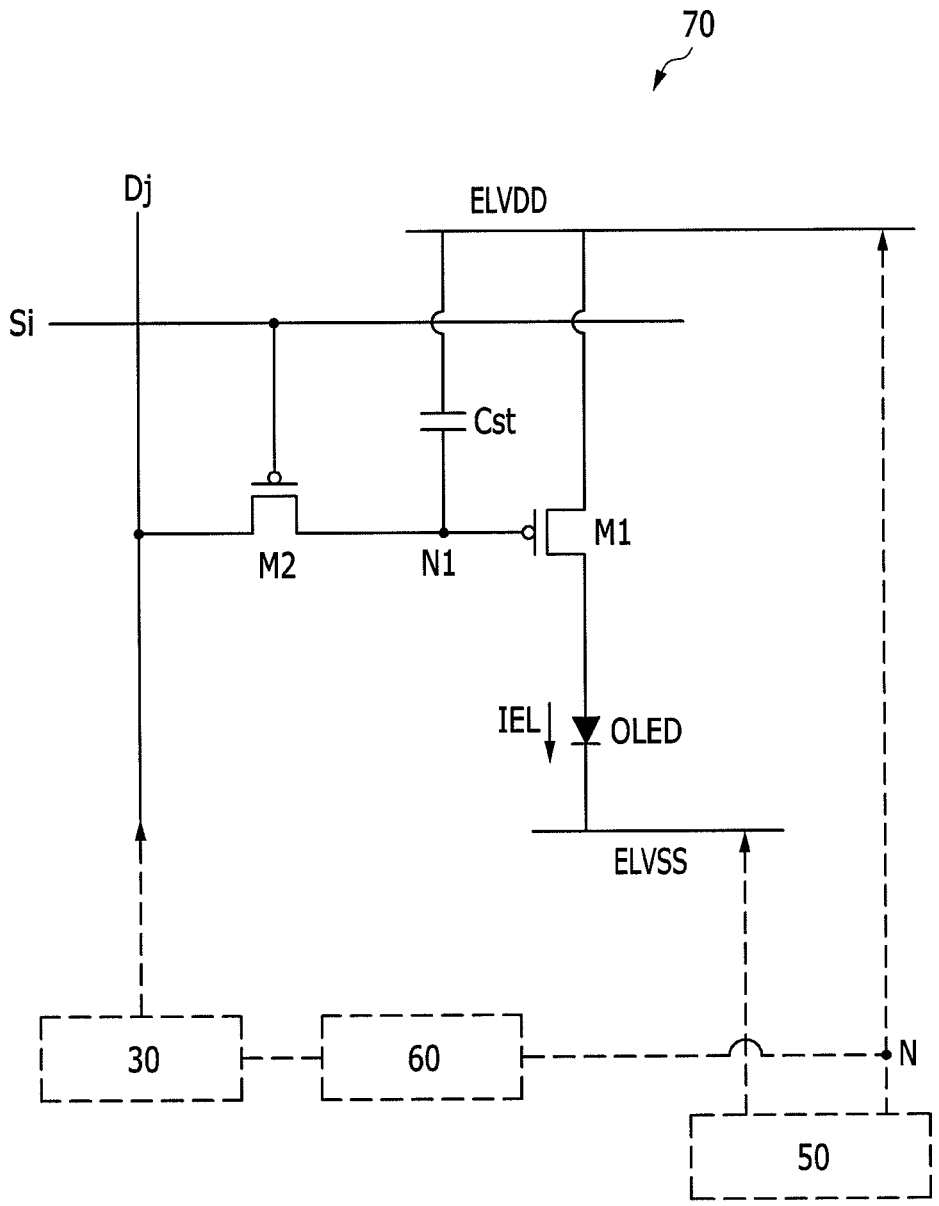
FIG. 2 is a circuit diagram of an example of a pixel included in a display unit of a display device.

FIG. 2 is a circuit diagram of an example of a pixel included in a display unit of a display device of FIG. 1. Specifically, FIG. 2 depicts a pixel disposed in a crossing region of the i-th scan line Si and the j-th data line Dj. The structure of the pixel (PXij) 70 connected to the i-th scan line Si and the j-th data line Dj is shown.

Referring to FIG. 2, the pixel 70 includes an organic light emitting diode (OLED) as an organic light emitting element, and a pixel driving circuit to control the OLED. The pixel driving circuit includes a driving transistor M1, a switching transistor M2, and a storage capacitor Cst.

In FIG. 2, the pixel includes two transistors and one capacitor, however it is not limited thereto, and the pixel circuit structure of the display device may be variously changed.

In the pixel 70 of FIG. 2, the driving transistor M1 includes the gate electrode connected to the drain electrode of the switching transistor M2, the source electrode connected to the first power source to receive the first power source voltage ELVDD, and the drain electrode connected to an anode of the organic light emitting diode (OLED).

As described above with reference to FIG. 1, the first power source voltage ELVDD is supplied to the source electrode of the driving transistor M1 through the power source wire connected to the power source voltage supply unit 50.

The switching transistor M2 includes the gate electrode connected to the scan line Si, the source electrode connected to the data line Dj, and the drain electrode connected to the gate electrode of the driving transistor M1.

The storage capacitor Cst includes one electrode connected to the gate electrode of the driving transistor M1 and the other electrode commonly connected to the first power source transmitting the first power source voltage ELVDD along with the source electrode of the driving transistor M1. The storage capacitor Cst charges the data voltage according to the data signal applied from data line Dj to the gate electrode of the driving transistor M1 and maintains it after the switching transistor M2 is turned off.

The OLED includes the anode connected to the drain electrode of the driving transistor M1 and the cathode connected to the second power source transmitting the second power source voltage ELVSS. As shown in FIG. 1, the second power source voltage ELVSS is supplied to the cathode of the OLED through the power source wire connected to the power source voltage supply unit 50. In some embodiments, the second power source voltage ELVSS may be a ground potential.

The driving transistor M1 and the switching transistor M2 forming the pixel of FIG. 2 may be a PMOS. Accordingly, a gate-on voltage for turning on the driving transistor M1 and the switching transistor M2 represents a logic low level voltage, and a gate-off voltage for turning them off represents a logic high level voltage. In the pixel of FIG. 2, the transistor is the PMOS, however at least one may be an n-channel field effect transistor (NMOS).

Accordingly, the data voltage applied to the gate electrode of the driving transistor M1 must be lower than the first power source voltage ELVDD transmitted to the source electrode of the driving transistor M1 in the pixel of FIG. 2 such that the driving transistor is turned on, and then the driving current (IEL) corresponding to the data voltage may flow to the organic light emitting diode (OLED). The current amount of the driving current (IEL) determines a luminance of the pixel and determines the color coordinate of the RGB pixel. In detail, the voltage (Vgs) corresponding to the difference between the gate electrode voltage and the source electrode voltage of the driving transistor M1 must be more than a threshold voltage (Vth) of the driving transistor M1, thereby forming a path of the driving current of the organic light emitting diode (OLED).

Referring to the operation of the pixel circuit of FIG. 2, if the scan signal corresponding to the gate-on voltage is transmitted to the scan line Si, the switching transistor M2 is turned on and the voltage according to the corresponding data signal is transmitted to the first node N1 through the data line Dj.

Thus, the data voltage is applied to one electrode of the storage capacitor Cst connected to the first node N1 and the first power source voltage ELVDD is applied from the first power connected to the other electrode of the storage capacitor Cst such that the storage capacitor Cst is charged with the voltage corresponding to the voltage difference between the two electrodes. That is, the voltage difference applied to both electrodes of the storage capacitor Cst corresponds to the voltage difference applied to the gate electrode and the source electrode of the driving transistor M1 such that storage capacitor Cst stores the voltage (Vgs) between the gate and the source of the driving transistor M1.

If the data voltage applied to the gate electrode of the driving transistor M1 is applied with the low level such that the voltage (Vgs) between the gate and the source of the driving transistor M1 is more than the threshold voltage (Vth) of the driving transistor M1, the driving transistor M1 of the PMOS is driven such that the path of the driving current is formed, and the OLED generates light corresponding to the current.

The data voltage transmitted to the gate electrode of the driving transistor M1 is transmitted through the data driver 30. The driving control device 60 connected to the data driver 30 obtains the voltage value of the first power source voltage ELVDD that is actually transmitted through the connection node (N) connected to the power source voltage supply unit 60, and the data signal transmitted from the data driver 30 may be compensated with the voltage value compensating the output deviation with the voltage value of the driving power source voltage in the process step (a luminance compensation step).

Accordingly, the value of the voltage (Vgs) between the gate and the source of the driving transistor M1 is changed by the data voltage corresponding to the data signal. The output deviation of the first power source voltage ELVDD is compensated such that the change of the light characteristics (the luminance, the color coordinate, etc.) of the pixel due to the output deviation of the driving voltage may be prevented.

Figure 4:
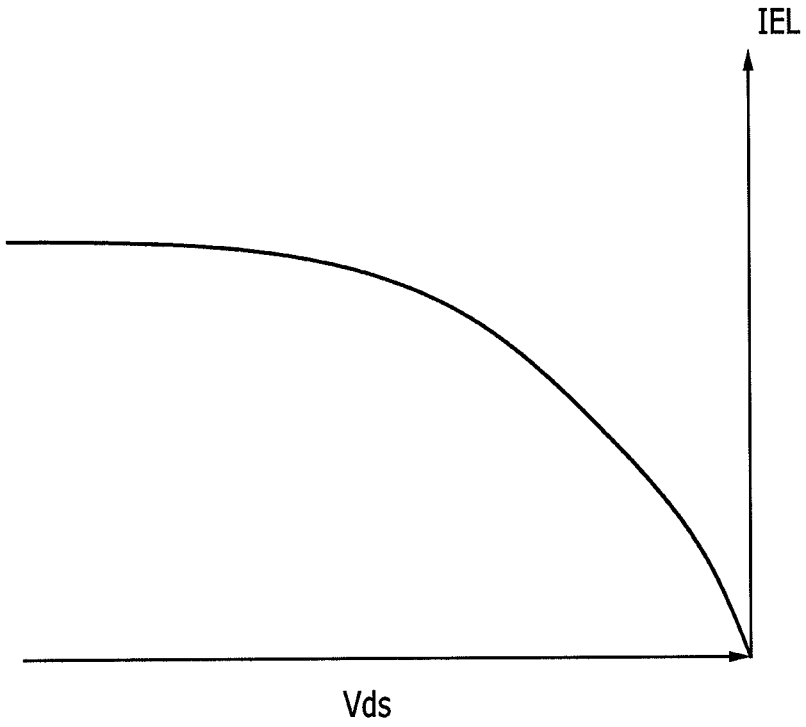
FIG. 4 is a graph of a relationship of a voltage (Vds) between a drain and a source and a driving current (IEL) of a driving transistor of a pixel in which an output deviation of a driving power source voltage is compensated.

FIG. 4 is a graph of a relationship of a voltage (Vds) of a drain-source and a driving current (IEL) of a driving transistor of a pixel of which an output deviation of a driving power source voltage is compensated according to a driving control method according to an exemplary embodiment of the present invention.

The graph of FIG. 4 shows an effect of the present invention. That is, the data voltage compensated with the output deviation of the driving power source voltage ELVDD is applied to the gate electrode of the driving transistor, thereby compensating an output change amount of the driving power source voltage applied to the source electrode of the driving transistor. Accordingly, the relationship curve of the voltage (Vds) between the drain and the source of the driving transistor and the driving current is uniform without a change width as shown by a solid line rather than dotted lines as shown in FIG. 3.

According to the present invention, regardless of the output change of the driving power source voltage, the voltage (Vgs) between the gate and the source of the driving transistor corresponding to the driving current (IEL) that is capable of displaying the image with the correct luminance according to the luminance information included in the external video signal DATA1 may be charged to the storage capacitor Cst.

Figure 5:
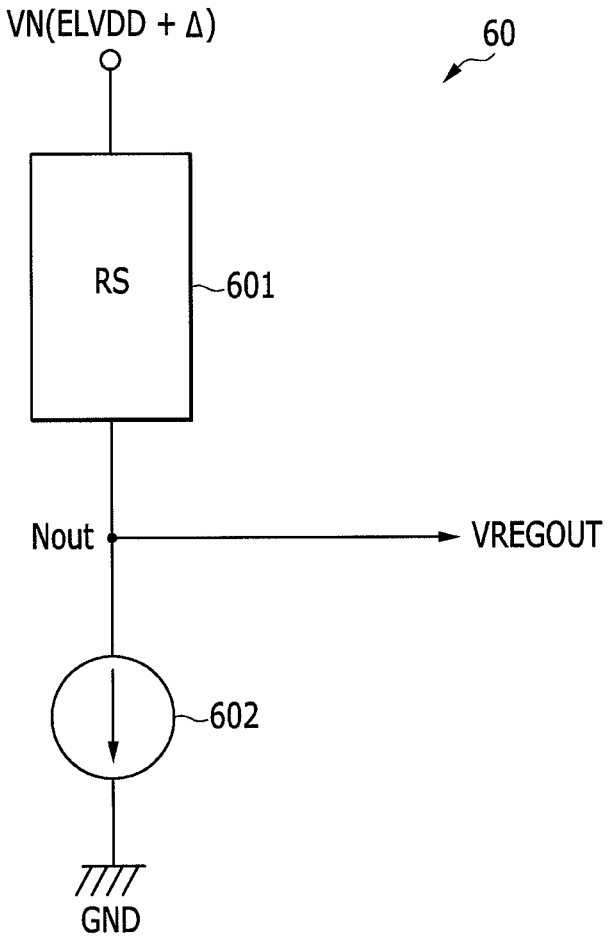
FIG. 5 is a schematic block diagram of an embodiment of a driving control device of a display device.
Figure 6:
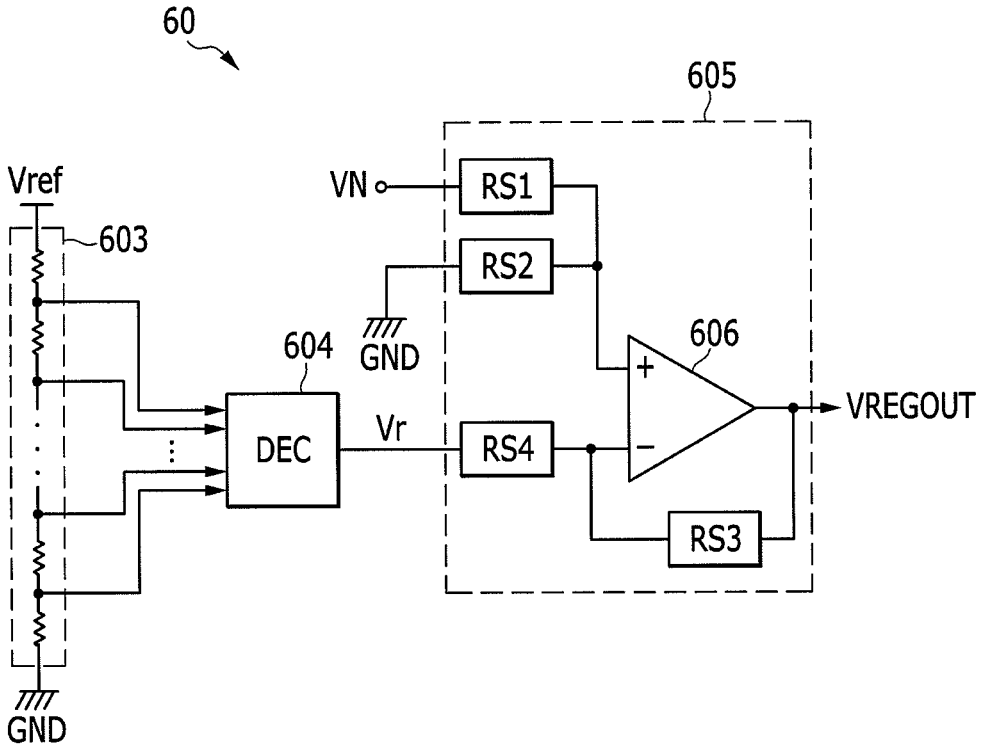
FIG. 6 is a schematic block diagram of an embodiment of a driving control device of a display device.
Figure 7:
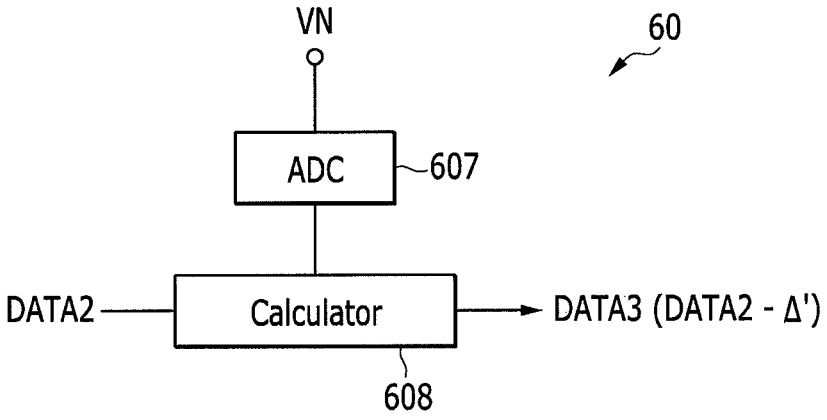
FIG. 7 is a schematic block diagram of an embodiment of a driving control device of a display device.

FIG. 5 to FIG. 7 are schematic block diagrams of embodiments of a driving control device 60 of a display device.

The driving control device 60 as depicted in FIG. 5 and FIG. 6 includes a means for obtaining the voltage value of the first power source voltage ELVDD that is output in real time from the power source voltage supply unit 50 in the display device, and predetermining and outputting a reference gamma voltage to the data driver 30 by using the same. Thus, the data driver 30 outputs the gray voltage (the gamma voltage) according to the image data signal DATA2 with reference to the reference gamma voltage that is newly predetermined through the driving control device 60 as the data signal.

Referring to FIG. 5, the driving control device 60 includes at least one register 601 and at least one current sink unit 602.

The at least one register 601 and the at least one current sink unit 602 are connected to an output node (Nout).

Although not shown in FIG. 5, the register 601 may include a plurality of resistors, and the driving power source voltage of the high level may be applied to the first resistor end. That is, the register 601 obtains an actual output voltage value (VN) of the first power source voltage ELVDD through the connection node (N) commonly connected to the power source voltage supply unit 50. Here, the voltage value (VN) is a voltage value (ELVDD+Δ) including the predetermined driving voltage value ELVDD and a predetermined deviation (the variation, Δ) due to the change of the arrangement environment of the DC-DC converter of the power source voltage supply unit 50 provided in the display device as the finished product.

The register 601 forms the current path such that the predetermined reference gamma voltage (VREGOUT) may be output to the output terminal (an output node, Nout) through the constitution of a plurality of resistors.

Also, the current sink unit 602 is connected to the output terminal (the output node, Nout), and the current sink unit sinks the predetermined current such that the current path may be formed from the output terminal (the output node, Nout) toward the ground terminal (GND).

The driving control device 60 of FIG. 5 adjusts the number of resistors in the register 601 and resistance or the sink current amount of the current sink unit 602 to output a reference gamma voltage (VREGOUT) from the voltage value (ELVDD+Δ) of the actual driving power source voltage input to the driving control device 60.

At this time, the reference gamma voltage (VREGOUT) is a value (ELVDD+Δ−Vr) of which the first voltage (Vr) corresponding to the threshold voltage (Vth) of the driving transistor of the pixel is subtracted from the actual output voltage value (ELVDD+Δ).

The output reference gamma voltage (VREGOUT) is transmitted to the data driver 30, and the data driver 30 uses the reference gamma voltage (VREGOUT) as the highest voltage value when dividing the gamma voltage corresponding to the image data signal DATA2. The reference gamma voltage (VREGOUT) becomes a voltage emitting light with the lowest grayscale in the pixel including the PMOS transistor.

Referring to FIG. 6, the driving control device 60 according includes a voltage generator 603, a decoder 604, and a reference voltage output unit 605.

The voltage generator 603 includes a plurality of resistors and a plurality of output terminals outputting a plurality of different division voltages between the resistors. In detail, the voltage generator 603 includes a plurality of resistors coupled in series between an input terminal input of the reference voltage (Vref) and the ground terminal of the ground potential. Also, the voltage generator 603 divides the voltage difference between the reference voltage (VREF) and the ground voltage (GND) to a plurality of resistors to generate a plurality of division voltages. The plurality of division voltages are respectively output to the decoder 604 through an output terminal (an output node) connected at nodes between the plurality of resistors.

The decoder 604 as a circuit unit made of a logic circuit receives a plurality of input signals and outputs only one signal. In the driving control device 60, the decoder 604 receives a plurality of division voltages generated from the voltage generator 603 as input signals, and may select and output the voltage from among the division voltages which is equal to the first voltage (Vr), which corresponds to the threshold voltage (Vth) of the driving transistor.

The threshold voltage value may vary according to material characteristics of the transistor of the pixel of the display panel. The first voltage (Vr) may be predetermined as an offset value for each display panel. However, it is not limited thereto, and a measuring value of the threshold voltage of the driving transistor of the pixel may be obtained before the operation of the driving control device.

The voltage generator 603 predetermines the reference voltage (Vref) for a plurality of division voltages to be output in a predetermined voltage range with reference to the first voltage (Vr), and may determine the number of resistors and the resistance.

The reference voltage output unit 605 determines the difference between the actual output voltage value (VN) of the first power source voltage ELVDD and the first voltage (Vr) output from the decoder 604, and outputs the difference as the reference gamma voltage (VREGOUT).

The reference voltage output unit 605 includes a plurality of registers and differential amplifiers 606 provided at each terminal. The plurality of registers may be constituted with a predetermined resistance.

In detail, a non-inverting input terminal (+) of the differential amplifier 606 is connected to the connection node (N) through the first register RS1. Accordingly, the non-inverting input terminal (+) of the differential amplifier 606 is input with the voltage value (VN) of the first power source voltage ELVDD that is actually output from the power source voltage supply unit 50. According to the exemplary embodiment, by connecting the second register RS2 to the non-inverting input terminal (+) of the differential amplifier 606, the voltage value (VN) of the first power source voltage ELVDD may be adjusted by the value of the constitution resistor of the first register RS1 and the second register RS2 and input.

Also, the inverting input terminal (−) of the differential amplifier 606 is input with the first voltage (Vr) output from the decoder 604. The inverting input terminal (−) and the output terminal of the differential amplifier 606 may be provided with a third register RS3, and the inverting input terminal (−) may be provided with a fourth register RS4. Thus, the first voltage (Vr) may be input to the inverting input terminal (−) of the differential amplifier 606 as the voltage value that is controlled by the constitution resistor of the third register RS3 and the fourth register RS4 and the resistance thereof.

The resistance of all registers (RS1 to RS4) may be the same.

If the resistance of all registers (RS1 to RS4) are the same, the reference gamma voltage (VREGOUT) output from the output terminal of the differential amplifier 606 may be the value ELVDD+Δ−Vr, where Vr corresponds to the threshold voltage (Vth) of the driving transistor of the pixel, and is subtracted from the actual output voltage value ELVDD+Δ.

As described, the reference gamma voltage (VREGOUT) output from the driving control device 60 of FIG. 5 and FIG. 6 includes the deviation between the first power source voltage supplied in the process of the display device and the first power source voltage supplied after the product processing. Also, the reference gamma voltage (VREGOUT) is predetermined as the highest voltage in the gray voltage division of the image data signal such that the voltage (Vgs) of the gate-source of the driving transistor is uniform despite the output deviation of the driving power source voltage Therefore, display characteristics, such as luminance and color coordinates are correctly maintained and displayed.

Referring to FIG. 7, the driving control device 60 includes a means for obtaining the voltage value of the first power source voltage ELVDD output from the power source voltage supply unit 50 in the display device in real time and means for outputting the image data signal compensated with the value corresponding to the output deviation of the first power source voltage ELVDD through a calculation with the digital data value of the image data signal DATA2. Thus, the data driver 30 outputs the gray voltage according to the compensation data signal output from the driving control device 60 as the data signal.

Specifically, referring to FIG. 7, the driving control device 60 includes a signal converter 607 and a calculator 608.

The signal converter 607 obtains the actual output voltage value (VN) of the first power source voltage ELVDD through the connection node (N) commonly connected along with the power source voltage supply unit 50. Also, the signal converter 607 converts the analog signal of the actual output voltage value (VN) of the first power source voltage ELVDD into the digital signal. The signal converter 607 may be an analog-digital converter ADC.

The actual output voltage value VN of the first power source voltage ELVDD after being converted into a digital signal in the signal converter 607 is transmitted to the calculator 608.

The calculator 608 receives the image data signal DATA2 according to the video signal from the signal controller 40. The image data signal DATA2 of the digital data value, and the digital value of the image data signal DATA2 corresponding to each pixel and the digital value of the actual output voltage value (VN), are calculated in the calculator 608 to compensate the output deviation of the driving power source voltage.

After the calculating process in the calculator 608, the compensation image data signal DATA3 is output. The output compensation image data signal DATA3 may be the digital value (DATA2−Δ) where the output deviation (Δ) between the first power source voltage supplied in the predetermined process of the gamma voltage and the first power source voltage supplied after the product is produced is subtracted from the input image data signal DATA2.

At this time, the calculation process performed in the calculator 608 is not limited, and the rest of the result value (Δ) may be subtracted from the input image data signal DATA2 after the voltage value of ELVDD that is predetermined as the corrected driving power source voltage is erased in the actual output voltage value (VN=ELVDD+Δ) that is converted into the digital signal.

The compensation image data signal DATA3 output from the calculator 608 of the driving control device 60 is transmitted to the data driver 30. The data driver 30 outputs the gray voltage corresponding to the compensation image data signal. At this time, the output deviation of the driving power source voltage is reflected to the gray voltage such that the image may be displayed with the correct luminance and color coordinate regardless of the output deviation of the driving power source voltage.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a display unit comprising a plurality of pixels, each pixel having a light emitting element, configured to emit light according to a driving current which corresponds to a data signal;

a plurality of scan lines connected to the plurality of pixels;

a scan driver configured to transmit a scan signal through each of the plurality of scan lines;

a plurality of data lines connected to the plurality of pixels;

a data driver configured to transmit a data signal through each of the plurality of data lines;

a power source voltage supply unit configured to supply a driving voltage to drive the plurality of pixels through a power source wire connected to the plurality of pixels; and a driving controller connected to the power source wire, wherein the driving controller is configured to obtain an actual output voltage value of the driving voltage, configured to generate and transmit to the data driver a reference gamma voltage to form a gray voltage corresponding to the data signal by using the actual output voltage value of the driving voltage, and configured to compensate for a deviation of a manufacturing driving voltage used in a manufacturing process by using the actual output voltage value of the driving voltage;

wherein the driving controller comprises: a voltage generator to which a plurality of resistors are connected;

a decoder configured to receive a voltage divided in the voltage generator and output a predetermined first voltage; and a reference voltage output unit configured to output a difference voltage between the actual output voltage value of the driving voltage and the first voltage as the reference gamma voltage.

2. The display device of claim 1, wherein the driving controller comprises a register including a plurality of resistors and a current sink unit configured to sink a predetermined current, and wherein the driving controller is configured to output the actual output voltage value of the driving voltage as the reference gamma voltage.

3. The display device of claim 1, wherein the predetermined first voltage is a threshold voltage of a driving transistor included in a plurality of pixels.

4. A display device comprising:

a display unit comprising a plurality of pixels, each pixel having a light emitting element, configured to emit light according to a driving current which corresponds to a data signal;

a plurality of scan lines connected to the plurality of pixels;

a scan driver configured to transmit a scan signal through each of the plurality of scan lines;

a plurality of data lines connected to the plurality of pixels;

a data driver configured to transmit a data signal through each of the plurality of data lines;

a power source voltage supply unit configured to supply a driving voltage to drive the plurality of pixels through a power source wire connected to the plurality of pixels; and a driving controller connected to the power source wire wherein the driving controller is configured to:

calculate the actual output voltage value of the driving voltage and the digital value of the image data signal corresponding to an external video signal, generate a compensation data signal in which the deviation with the driving voltage in the manufacturing process is compensated by using the actual output voltage value of the driving voltage wherein the compensation data signal is equal to the manufacturing driving voltage included in the actual output voltage value of the driving voltage subtracted from the digital value of the image data signal input to the driving controller, and transmit the compensation data signal to the data driver.

5. The display device of claim 4, wherein the driving controller comprises a signal converter and a calculator, and wherein the signal converter converts an analog signal of the actual output voltage value into a digital signal.

6. A driving control device driving a plurality of pixels each pixel comprising:

a light emitting element and a driving transistor connected to one end of the light emitting element, the driving transistor configured to transmit a driving current according to a data signal transmitted from a data line to the light emitting element, wherein the driving control device comprises:

a voltage generator comprising a plurality of interconnected resistors;

a decoder receiving a voltage divided in the voltage generator configured to output a predetermined first voltage, a reference voltage output unit configured to output a voltage difference between an actual output voltage value and the first voltage as the reference gamma voltage; and a compensation means configured to compensate for a deviation with the manufacturing driving voltage by using the actual output voltage value of the driving voltage;

wherein the driving control device is configured to obtain the actual output voltage value from a power source which supplies a driving voltage to drive the plurality of pixels and to generate and transmit the reference gamma voltage for forming a gray voltage according to the data signal respectively transmitted to the plurality of pixels by using the actual output voltage value.

7. The driving control device of claim 6, wherein the reference gamma voltage is a voltage value where a threshold voltage of a driving transistor included in a plurality of pixels is subtracted from the actual output voltage value of the driving voltage.

8. The driving control device of claim 6, wherein the compensation means of the driving control device comprises a register including a plurality of resistors and a current sink unit configured to sink a predetermined current, and configured to output the actual output voltage value of the driving voltage as the reference gamma voltage.

9. The driving control device of claim 6, wherein the compensation means of the driving control device comprises:

a voltage generator comprising a plurality of interconnected resistors;

a decoder receiving a voltage divided in the voltage generator configured to output a predetermined first voltage, and a reference voltage output unit configured to output a voltage difference between the actual output voltage value and the first voltage as the reference gamma voltage.

10. The driving control device of claim 9, wherein the first voltage is a threshold voltage of a driving transistor included in the plurality of pixels.

11. The driving control device of claim 9, wherein the voltage generator includes a plurality of resistors coupled in series between the reference voltage and a ground voltage, and wherein the voltage generator is configured to predetermine the reference voltage, a number of a plurality of resistors, and a resistance to generate a plurality of division voltages in a predetermined voltage range with reference to the first voltage.

12. The driving control device of claim 9, wherein the reference voltage output unit includes a differential amplifier configured to output a difference voltage between the actual output voltage value and the first voltage as the reference gamma voltage.

13. The driving control device of claim 6, wherein the compensation means of the driving control device is a means for:

calculating the actual output voltage value and the digital value of the image data signal corresponding to an external video signal;

generating a compensation data signal in which the deviation with the manufacturing driving voltage during a manufacturing step is compensated; and transmitting the compensation data signal to a plurality of pixels.

14. The driving control device of claim 13, wherein the compensation means of the driving control device includes:

a signal converter configured to convert an analog signal of the actual output voltage value of the driving voltage into a digital signal, and a calculator configured to calculate the actual output voltage value of the digital signal and the digital value of the image data signal.

15. The driving control device of claim 14, wherein the calculator subtracts a deviation from the manufacturing driving voltage included in the actual output voltage value that is converted into the digital signal from the digital value of the image data signal.

16. A method for driving a plurality of pixels having a light emitting element and a driving transistor connected to one end of the light emitting element comprising:

transmitting a driving current according to a data signal transmitted from a data line to the light emitting element;

obtaining an actual output voltage value output from a power supply device which supplies a driving voltage to drive the plurality of pixels; and compensating a deviation with the manufacturing driving voltage with a compensation data signal by using the actual output voltage value of the driving voltage, wherein the compensating includes generating and transmitting a reference gamma voltage to form a gray voltage according to the data signal respectively transmitted to a plurality of pixels by using the actual output voltage value of the driving voltage and wherein the compensation data signal is a value where the deviation with the manufacturing driving voltage included in the actual output voltage value that is converted into the digital signal is subtracted from the digital value of the image data signal.

17. The driving control method of claim 16, wherein the reference gamma voltage is a threshold voltage of the driving transistor included in the plurality of pixels subtracted from the actual output voltage value of the driving voltage.

18. A driving control method driving a plurality of pixels including a light emitting element and a driving transistor connected to one end of the light emitting element and transmitting a driving current according to a data signal transmitted from a data line to the light emitting element, comprising:

obtaining an actual output voltage value output from a power source voltage supply device supplying a driving voltage to drive a plurality of pixels; and compensating a deviation with the manufacturing driving voltage used during a manufacturing step by using the actual output voltage value, wherein the compensating includes:

converting an analog signal of the actual output voltage value into a digital signal, calculating the actual output voltage value converted into the digital signal and the digital value of the image data signal corresponding to an external video signal, and generating a compensation data signal compensating a deviation from the driving voltage by a result value of a calculation, wherein the compensation data signal is a value where the deviation with the manufacturing driving voltage included in the actual output voltage value that is converted into the digital signal is subtracted from the digital value of the image data signal; and transmitting the compensation data signal to the plurality of pixels.

19. A display device comprising:

a display unit comprising a plurality of pixels, each pixel having a light emitting element, configured to emit light according to a driving current which corresponds to a data signal;

a plurality of scan lines connected to the plurality of pixels;

a scan driver configured to transmit a scan signal through each of the plurality of scan lines;

a plurality of data lines connected to the plurality of pixels;

a data driver configured to transmit a data signal through each of the plurality of data lines;

a power source voltage supply unit configured to supply a driving voltage to drive the plurality of pixels through a power source wire connected to the plurality of pixels; and a driving controller connected to the power source wire, configured to:

calculate the actual output voltage value of the driving voltage and the digital value of the image data signal corresponding to an external video signal, generate a compensation data signal in which the deviation with the driving voltage in the manufacturing process is compensated, and transmit the compensation data signal to the data driver obtain an actual output voltage value of the driving voltage; and wherein the compensation data signal is equal to the manufacturing driving voltage included in the actual output voltage value of the driving voltage subtracted from the digital value of the image data signal input to the driving controller.

* * * * *